US007258503B2

(12) United States Patent
Lu

(10) Patent No.: US 7,258,503 B2
(45) Date of Patent: Aug. 21, 2007

(54) ADJUSTMENT DEVICE FOR PRINTER HEAD OF BARCODE PRINTER

(75) Inventor: Wen Chin Lu, Tucheng (TW)

(73) Assignee: Taiwan Semiconductor Co., Ltd., Taipei County (TW)

( * ) Notice: Subject to any disclaimer, the term of this patent is extended or adjusted under 35 U.S.C. 154(b) by 408 days.

(21) Appl. No.: 11/020,099

(22) Filed: Dec. 27, 2004

(65) Prior Publication Data

US 2006/0140697 A1 Jun. 29, 2006

(51) Int. Cl.
*B41J 29/06* (2006.01)

(52) U.S. Cl. ..... 400/691; 400/693; 400/718.2; 312/208.1; 312/208.4; 312/301; 312/306

(58) Field of Classification Search ..... 312/208.1, 312/208.4, 301, 306; 400/691, 692, 693, 400/718.2
See application file for complete search history.

(56) References Cited

U.S. PATENT DOCUMENTS 6,079,306 A * 6/2000 Liu ..... 83/454
6,230,903 B1 * 5/2001 Abbott ..... 211/26
6,709,178 B2 * 3/2004 Trescazes ..... 400/691
2003/0034447 A1 * 2/2003 Krohn et al. ..... 250/239

* cited by examiner

*Primary Examiner*—Daniel J. Colilla
*Assistant Examiner*—Kevin D. Williams
(74) *Attorney, Agent, or Firm*—Rosenberg, Klein & Lee

(57) ABSTRACT

A device for adjusting the position of a printer head of a barcode printer includes a casing mounted to the barcode printer and a base movably coupled to the casing. A slide board is slidably supported on the base and carries the printer head. A first adjuster is arranged between the slide board and the base to selectively move and thus adjust the position of the printer head in the longitudinal direction. A second adjuster couples the first adjuster to the base to selectively move the slide board on the base in the transverse direction, which in turn adjusts the transverse position of the printer head. A third adjuster couples the base to the casing to selectively move the base with respect to the casing and thus adjust the position of the printer head in the vertical direction. Thus, the position of the printer head can be adjusted in the longitudinal, transverse, and vertical directions, which allows a user to do precise adjustment of the printer head with respect to a printing medium on which a barcode is to be printed by the barcode printer.

23 Claims, 11 Drawing Sheets

ADJUSTMENT DEVICE FOR PRINTER HEAD OF BARCODE PRINTER

BACKGROUND OF THE INVENTION

1. Field of the Invention

The present invention generally relates to the field of barcode printer, and in particular, to a device for position adjustment of a barcode printer head in longitudinal, transverse, vertical directions.

2. The Related Art

Barcode is commonly printed on or attached to merchandise to simplify processing and sales of the merchandises. Most of the barcodes are printed in a stick, which is then attached to the merchandises. Due to the difference in size, thickness, and even material that makes the stick, barcode printers having printer heads set in different spatial positions are needed to process sticks of different specifications. This causes undesired troubles for barcode printer users.

The present invention is aimed to provide a barcode printer that allows for adjustment of position of the printer head in order to accommodate sticks of different specifications.

SUMMARY OF THE INVENTION

Thus, an objective of the present invention is to provide a device for adjusting position of a printer head of a barcode printer in longitudinal direction, transverse direction, and vertical direction whereby the barcode printer can accommodate barcode sticks of different specifications.

To achieve the above objective, in accordance with the present invention, a device for adjusting the position of a printer head of a barcode printer is provided, comprising a casing mounted to the barcode printer and a base movably coupled to the casing. A slide board is slidably supported on the base and carries the printer head. A first adjuster is arranged between the slide board and the base to selectively move and thus adjust the position of the printer head in the longitudinal direction. A second adjuster couples the first adjuster to the base to selectively move the slide board on the base in the transverse direction, which in turn adjusts the transverse position of the printer head. A third adjuster couples the base to the casing to selectively move the base with respect to the casing and thus adjust the position of the printer head in the vertical direction. Thus, the position of the printer head can be adjusted in the longitudinal, transverse, and vertical directions, which allows a user to do precise adjustment of the printer head with respect to a printing medium on which a barcode is to be printed by the barcode printer.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
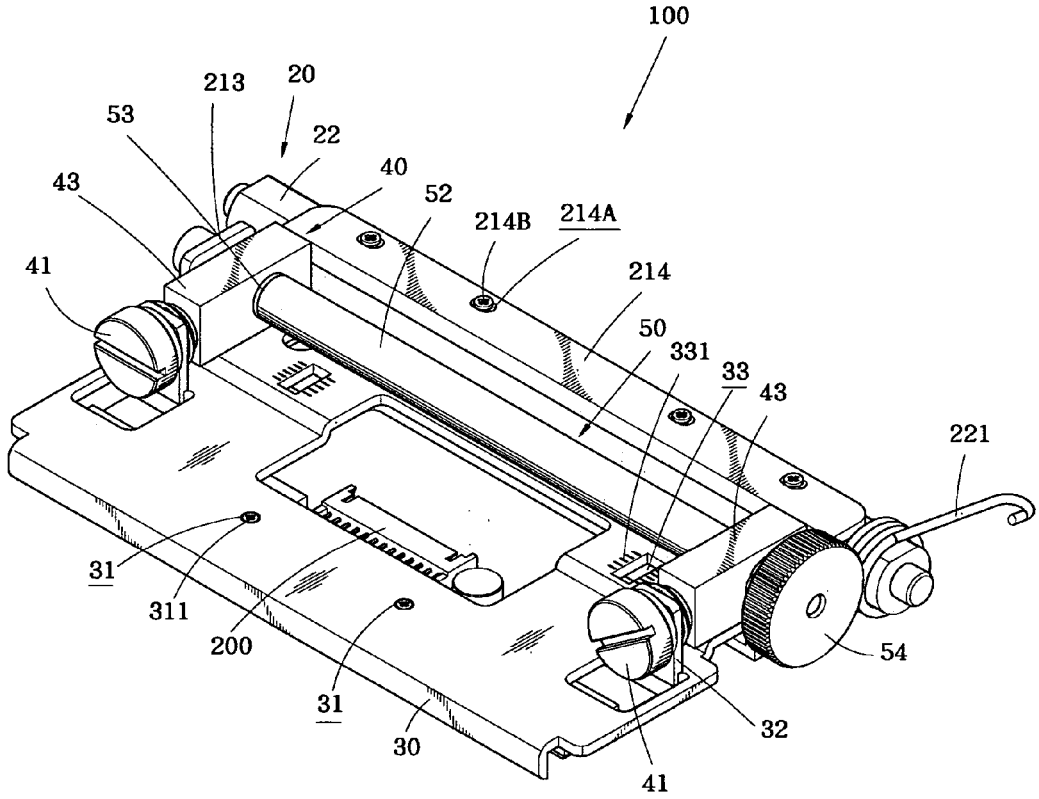
FIG. 1 is a perspective view of an adjustment device for a barcode printer head in accordance with the present invention with a casing removed for showing inside details.
Figure 2:
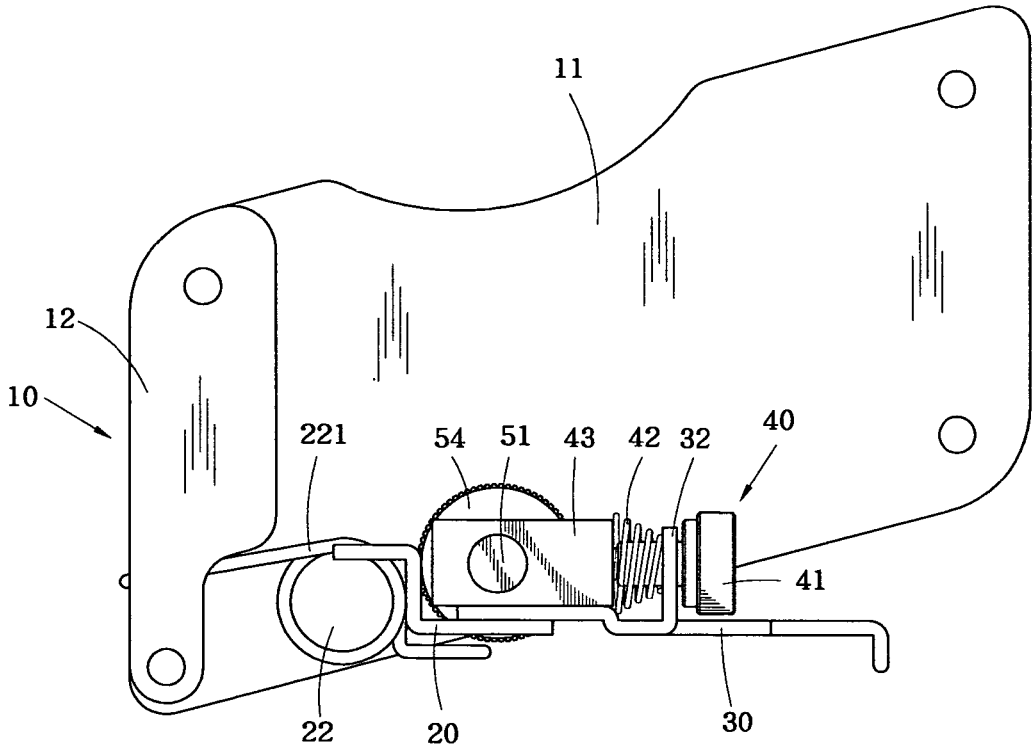
FIG. 2 is a side elevational view of the adjustment device of the present invention.
Figure 3:
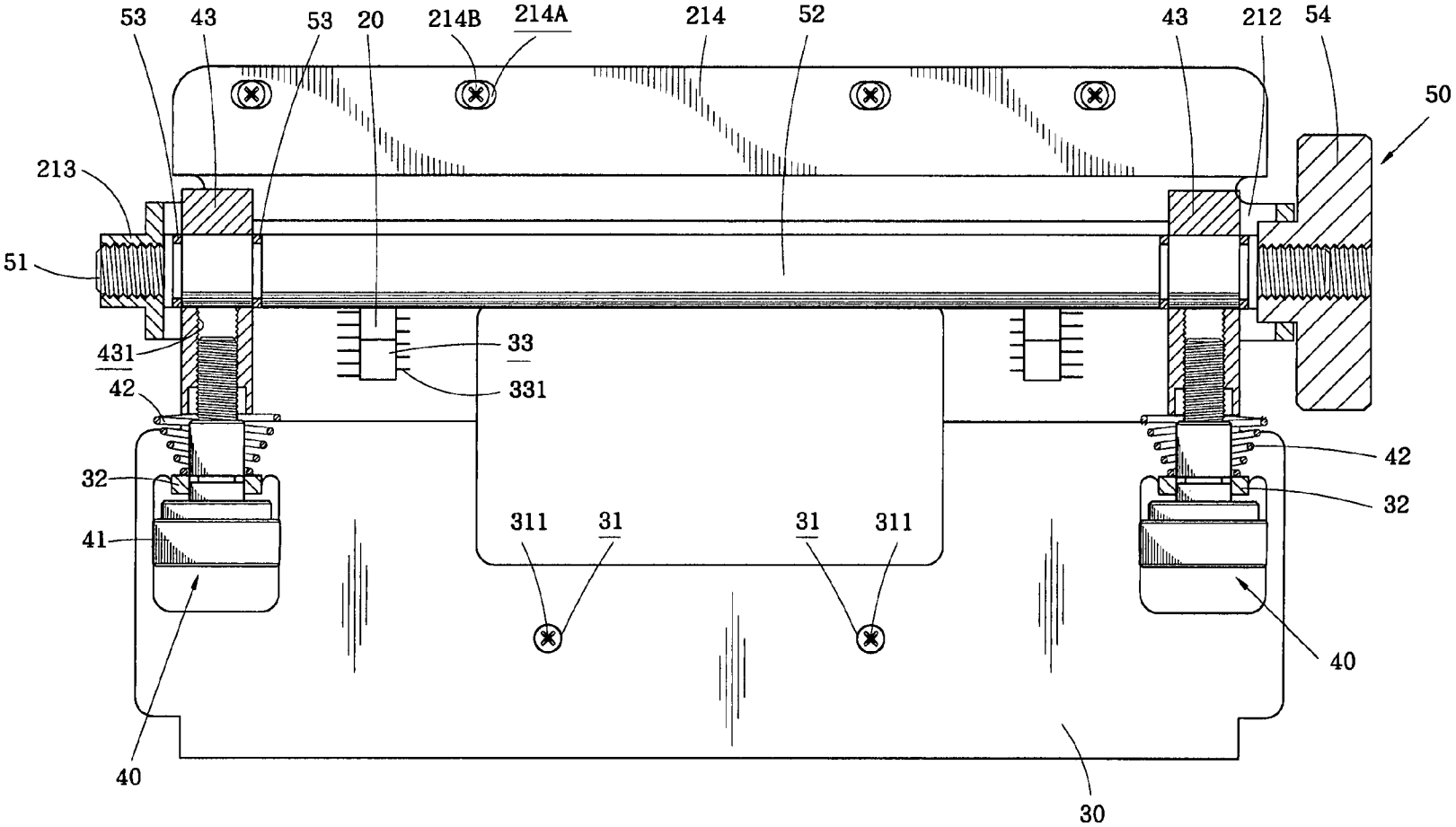
FIG. 3 is a top view of the adjustment device of the present invention with the casing removed.

With reference to the drawings and in particular to FIGS. 1-3, a device for adjustment of position of a barcode printer head in accordance with the present invention, generally designated with reference numeral 100, comprises a casing 10 mounted to a frame of the barcode printer (not shown) and a base 20 movable coupled to the casing 10. A slide board 30 is slidably supported on the base 20. The adjustment device 100 comprises a first, longitudinal adjuster 40, a second, transverse adjuster 50, and a third, vertical adjuster 60. The casing 10 comprises two spaced side plates 11 (best seen in FIG. 11) and a retention plate 12 connecting between the side plates 11. Each side plate 11 defines an elongated hole 111 (see FIG. 5).

The base 20 comprises a bottom board 21 having opposite edges in a transverse direction, each edge forming a retainer 212, 213. The retainer 213 forms an inner-threaded hole 213A. A transversely-extending offset flange 214 is formed along a rear edge of the bottom board 21. Holes 214A are defined in the flange 214 for receiving bolts 214B. A transversely-extending connection bar 22 is arranged below and substantially co-extensive with the flange 214 with opposite ends of the connection bar 22 extending through the elongated holes 111 of the side plates 11 for coupling with the vertical adjuster 60. The connection bar 22 is fixed to the flange 214 by the bolts 214B. A helical spring 221 is fit over and encompassing one end of the connection bar 22 and has an end attached to the retention plate 12 for coupling the base 20 to the casing 11 in a resilient manner so that the base 20 is allowed to move with respect to the casing 11.

The slide board 30 has a longitudinal rear section partially and slidably supported on the bottom board 21 of the base 20 and a longitudinal front section in which holes 31 are defined to receive bolts 311 that secure a printer head 200 (see FIG. 12) to the slide board 30. Two upright retention lugs 32 are formed on the front section of the slide board 30. Observing windows 33 are formed in the rear section of the slide board 30, which windows expose a front edge of the bottom board 21. Indexing marks 311 are formed along edges of the observing windows 33 for indicating the relative position of the slide board 30 with respect to the base 20.

Figure 4:
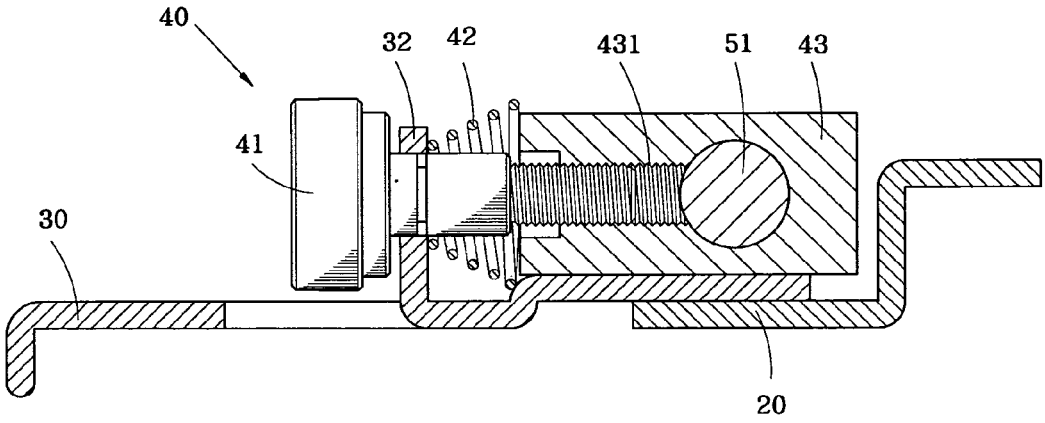
FIG. 4 is a cross-sectional view of a longitudinal adjuster of the adjustment device in accordance with the present invention.

Also referring to FIG. 4, the longitudinal adjuster 40 comprises two adjusting bolts 41, each extending through a hole (not labeled) defined in each retention lug 32 of the slide board 30, and further extending through a helical spring 42 and engaging a longitudinally-extending inner-threaded hole 431 defined in a connection arm 43. A transversely-extending hole 432 is defined in each connection arm 43.

The transverse adjuster 50 comprises a threaded rod 51 and a tube 52 fit over the threaded rod 51. The threaded rod 51 extends in the transverse direction through the retainers 212, 213 of the bottom board 21 of the base 20 and the transversely-extending holes 432 defined in the connection arms 43 of the longitudinal adjuster 40. One end of the threaded rod 50 threadingly engages the inner-threaded hole 213A of the retainer 213. A knob 54 is threadingly fixed to an opposite end of the threaded rod 50. C-clips 53 are mounted to the threaded rod 50 on opposite sides of each connection arm 43 for fixing the tube 52 with respect to the connection arms 43.

Figure 5:
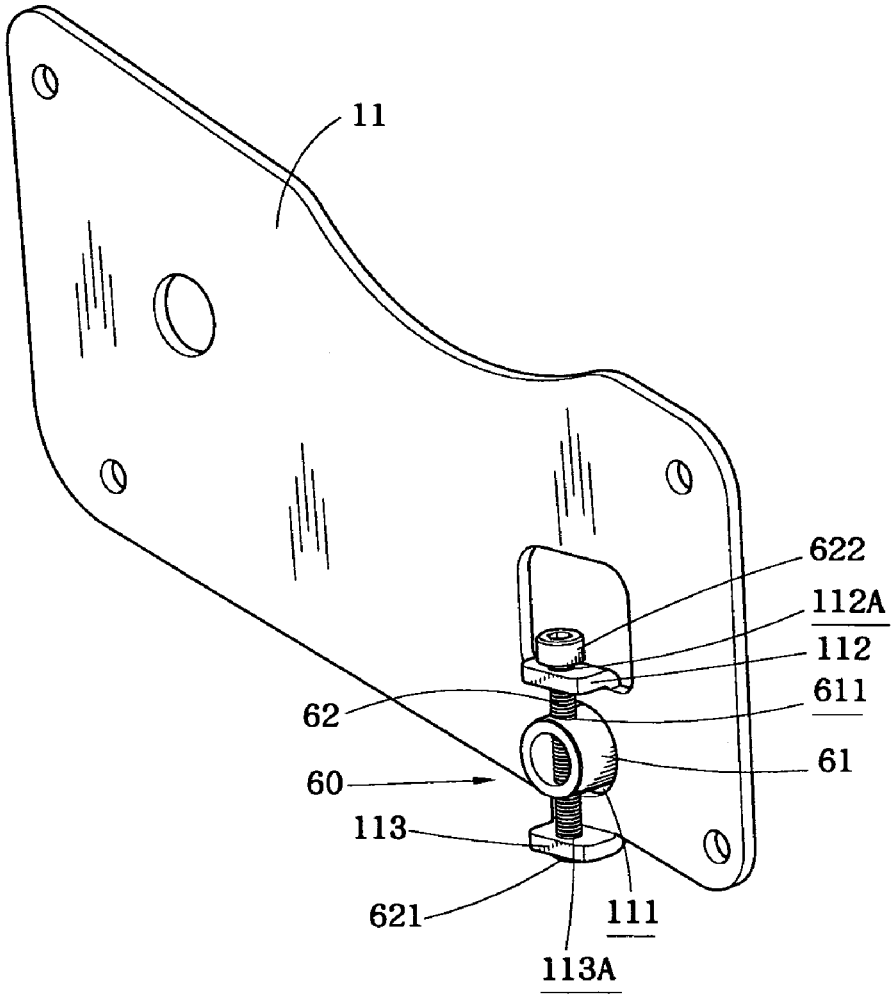
FIG. 5 is a perspective view of a vertical adjuster of the adjustment device in accordance with the present invention.
Figure 6:
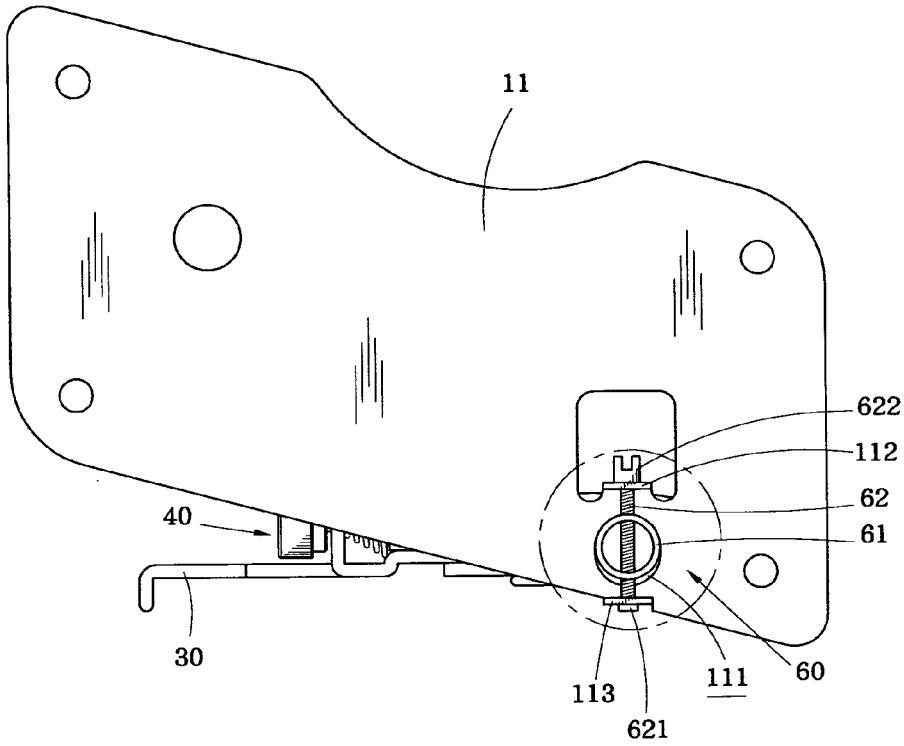
FIG. 6 is a side elevational view of the vertical adjuster.
Figure 7:
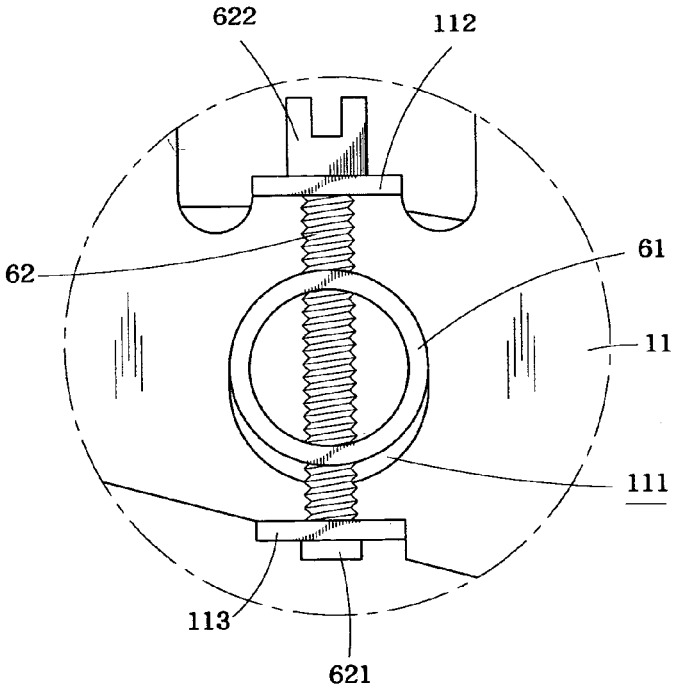
FIG. 7 is an enlarged view of encircled portion A of FIG. 6.

Also referring to FIGS. 5-7, the vertical adjuster 60 comprises a movable base 61 coupled to each side plate 11 by having an end of the movable base 61 extending through the elongated hole 111 of the side plate 11. Opposite ends of the connection bar 22 are fixed to the movable bases 61 whereby vertical position of the connection bar 22, and thus the base 20, can be adjusted by the movable bases 61 of the vertical adjuster 60. Each movable base 61 defines a vertically-extending inner-threaded hole 611 with which a vertically-extending threaded rod 62 engages. Lugs 112, 113 are formed on opposite sides of the elongated hole 111 in the vertical direction and define inner-threaded holes 112A, 113A with which opposite upper and lower ends of the threaded rod 62 engage. The upper end of the threaded rod 62 forms an operation head 622, allowing manual rotation of the threaded rod 60 to adjust the vertical position of the connection bar 22 and the base 20. The lower end of the threaded rod 62 forms a stop 621 located outboard the lug 113 for limiting the vertical movement of the threaded rod 62.

Figure 8:
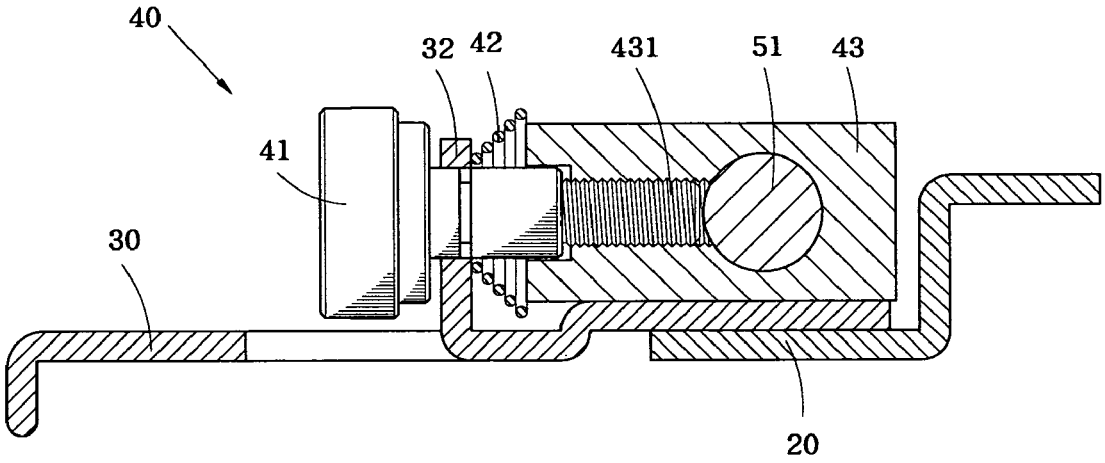
FIG. 8 is similar to FIG. 4 but showing a different position of the longitudinal adjuster.

Also referring to FIG. 8, which illustrates the adjustment of longitudinal position of the printer head 200 performed with the longitudinal adjuster 40 of the adjustment device 100 in accordance with the present invention. Due to the threading engagement between the adjusting bolts 41 and the inner-threaded hole 431 of the connection arms 43, rotation of the bolts 41 drives linear movement of the slide board 30 in the longitudinal direction with respect to the connection arms 43, which rotation also causes deformation of the springs 42. Since the connection arms 43 are fixed to the base 20 by the threaded rod 51 that is coupled to both the connection arms 43 and the retainers 212, 213 of the base 20, the linear movement of the slide board 30 with respect to the connection arms 43 also causes a linear displacement of the side board 30 with respect to the bottom board 21 of the base 20, namely sliding of the slide board 30 on the bottom board 21. This accomplishes the adjustment of the longitudinal position of the printer head 200 that is fixed to the slide board 30. FIG. 8 shows the slide board 30 at an extreme position in the longitudinal direction where the bolts 41 are completely threaded into the inner-threaded holes 431 of the connection arms 43. The distance of the linear movement of the slide board 30 with respect to the bottom board 21 of the base 20 is indicated by the indexing marks 331 formed along the observing windows 33 in the slide board 30.

Figure 9:
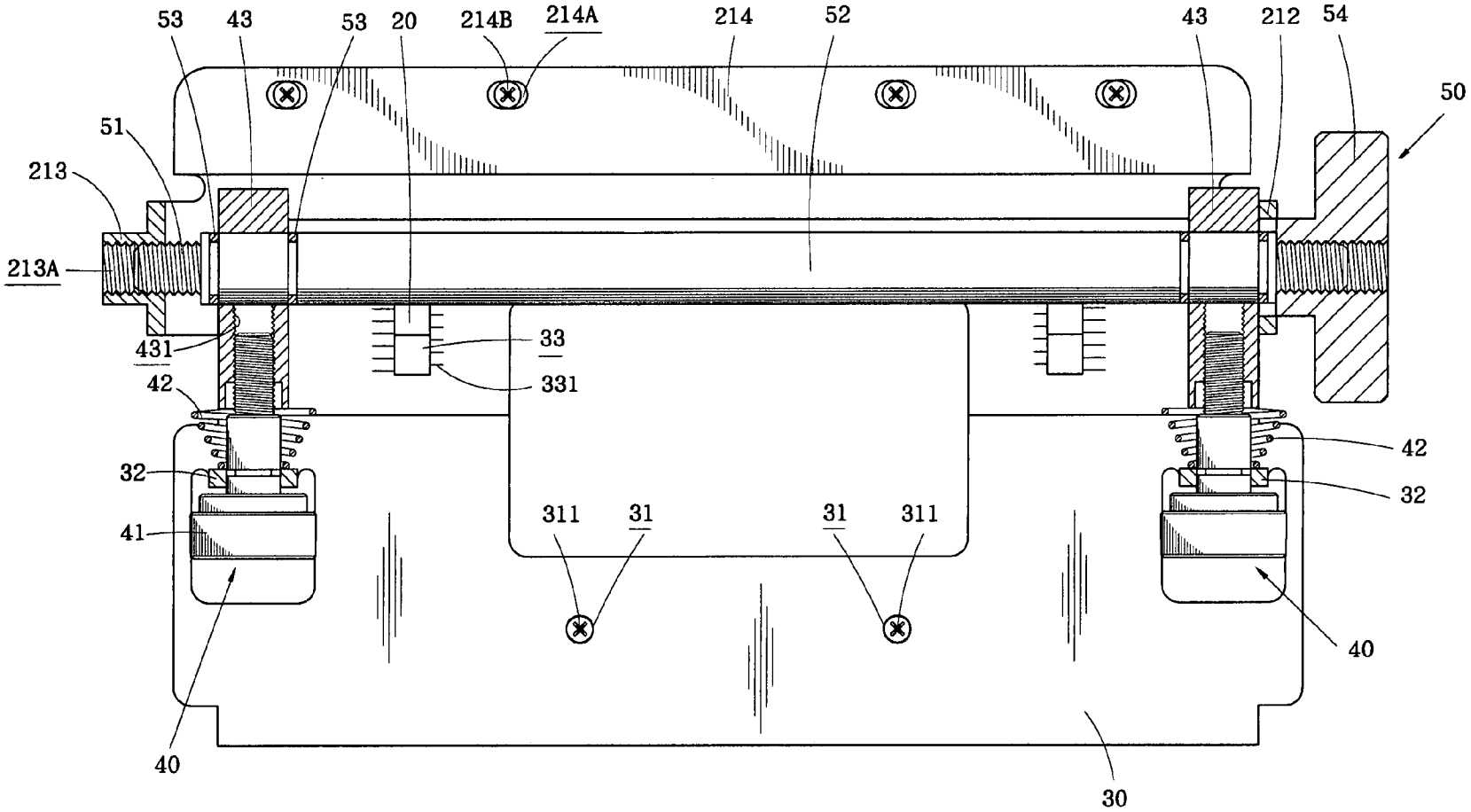
FIG. 9 is similar to FIG. 3 but showing a transverse adjuster in a different position from that of FIG. 3.

Also referring to FIG. 9, which illustrates the adjustment of transverse position of the printer head 200 performed with the transverse adjuster 50 of the adjustment device 100 in accordance with the present invention. The threaded rod 50 is rotated by manually driving the knob 54 in clockwise or counterclockwise direction. Due to the threading engagement between the threaded rod 50 and the inner-threaded hole 213A of the retainer 213 of the base 20, the rotation of the threaded rod 50 is converted into linear movement in the transverse direction, whereby the slide board 30 that is coupled to the threaded rod 50 by the connection arms 43 attached to the threaded rod 50 is moved with the threaded rod 50 with respect to the bottom board 20 of the base 20 in the transverse direction. FIG. 9 shows the slide board 30 at an extreme position in the transverse direction where the threaded rod 51 is moved in a direction to disengage from the retainer 213 and as a result, the slide board 30, as well as the printer head 200, is moved rightward as viewed in the drawing of FIG. 9.

Figure 10:
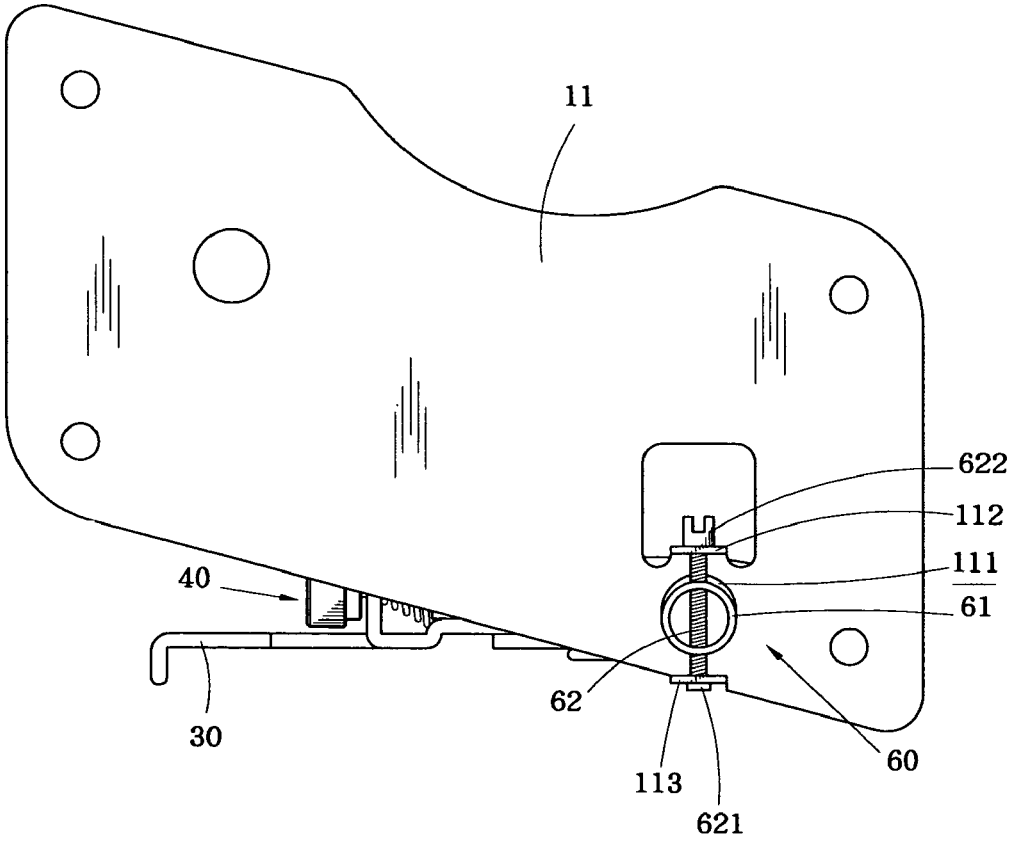
FIG. 10 is similar to FIG. 6 but showing a different position of the vertical adjuster.

Also referring to FIG. 10, which illustrates the adjustment of vertical position of the printer head 200 performed with the vertical adjuster 60 of the adjustment device 100 in accordance with the present invention. By manually rotating the threaded rod 62 with the operation head 622, the movable base 61 is moved vertically along the elongated hole 111 defined in the side board 11 due to the threading engagement between the threaded rod 62 and the movable base 61. Since the connection bar 22 that is fixed to the flange 214 of the base 20 is coupled to the movable base 61, the connection bar 22 and thus the base 20 are vertically movable in unison with the movable base 61 thereby accomplishing adjustment of the vertical position of the printer head 200 that is fixed to the slide board 30 that is in turn supported by the bottom plate 21 of the base 20.

Figure 11:
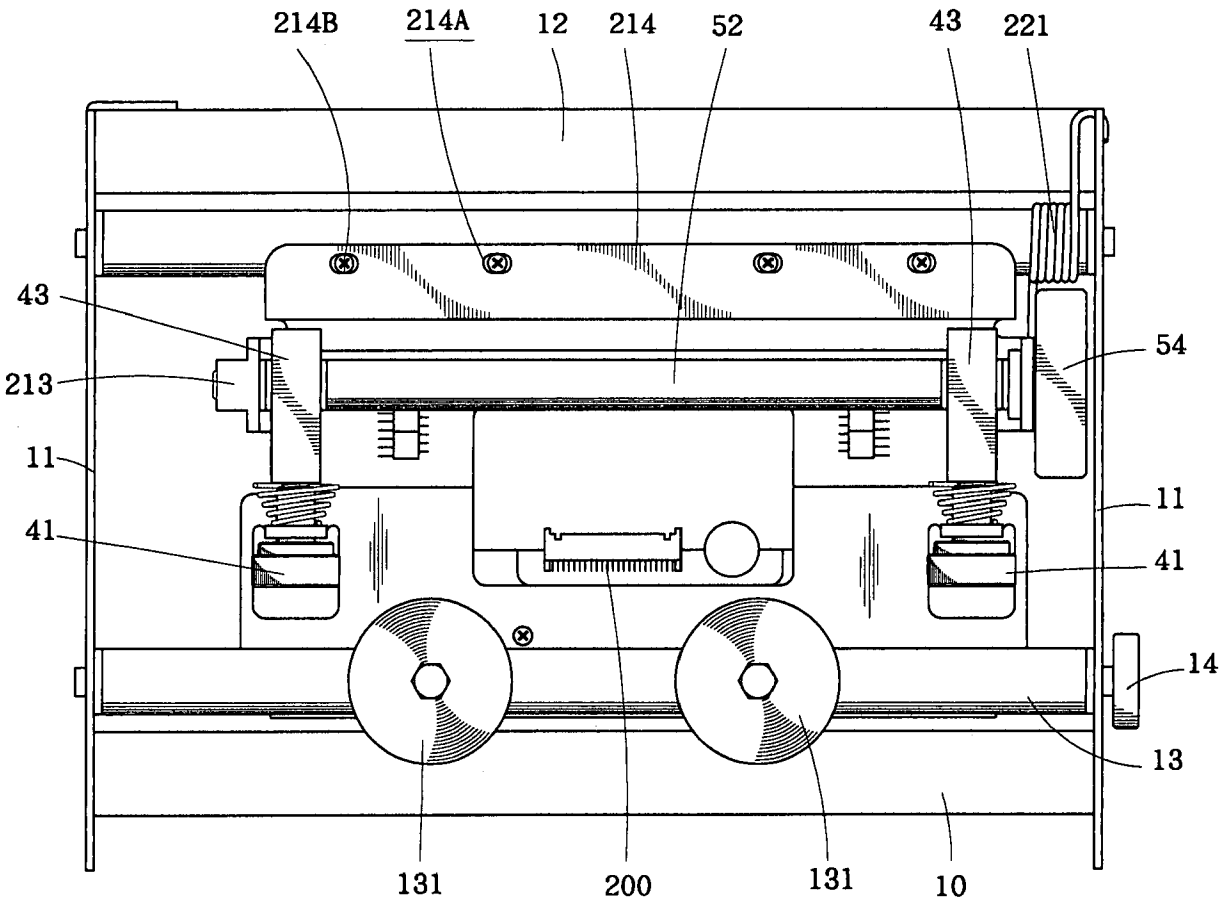
FIG. 11 is a top view illustrating a practical application of the adjustment device of the present invention in a barcode printer.
Figure 12:
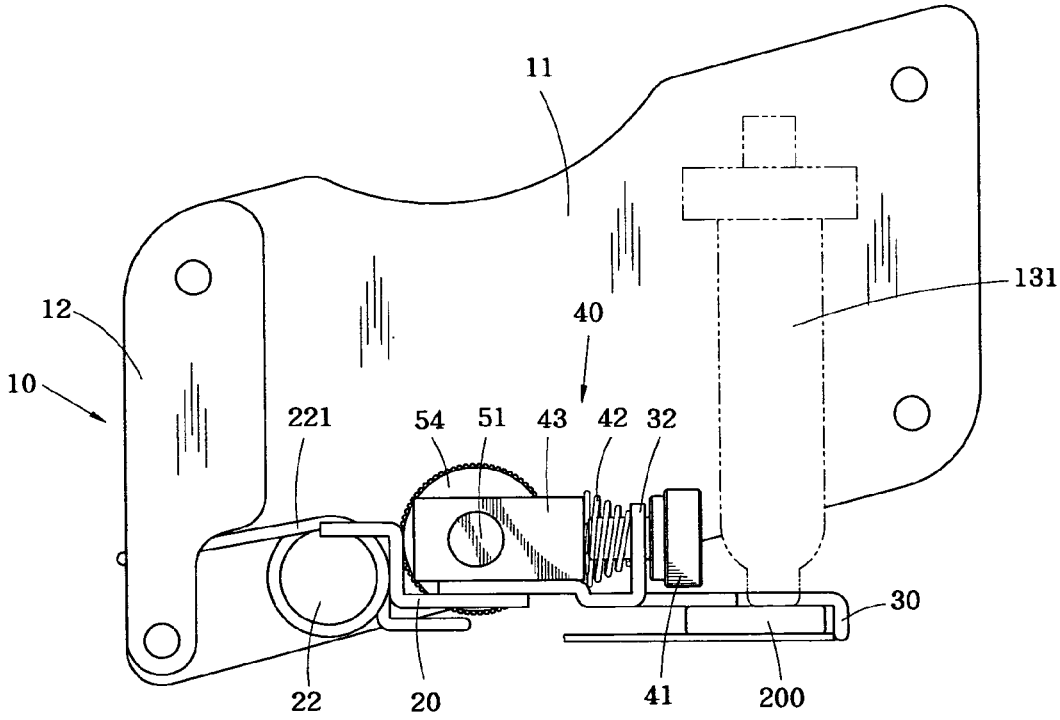
FIG. 12 is a side elevational view illustrating the printing operation of the barcode printer incorporating the adjustment device in accordance with the present invention.

Also referring to FIGS. 11 and 12, in a barcode printer, a cross bar 13is arranged between the side plates 11 of the casing 10 and at least one presser 131 is mounted to the cross bar 13. The presser 131 is movable toward the printer head 200 that is fixed to the slide board 30 by manually operating a control switch 14 that is coupled to the cross bar 13 and located outboard the side plate 11. This forces the printer head 200 against a barcode stick 300 on which barcode is to be printed by the printer head 200. The spatial relationship between the printer head 200 and the stick 300 can be adjusted by operating any one of the longitudinal adjuster 40, the transverse adjuster 50, and the vertical adjuster 60, or in combination. This provides a precise and adjustable positioning of the printer head 200 with respect to the stick 300 whereby sticks of different specifications can be accommodated in the barcode printer.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. An adjustment device adapted to adjust position of barcode printer head comprising:

a casing comprising two space side plates and a retention plate connecting between the side plates;

a base comprising a bottom board and a transversely-extending connection member fixed to the bottom board and having opposite ends;

a slide board having a longitudinal rear section slidably and partially supported by the bottom board, the slide board being adapted to fix the barcode printer head;

first adjusting means arranged between the base and the slide board for adjusting a longitudinal position of the slide board with respect to the base in a longitudinal direction;

second adjusting means arranged between the slide board and the base for adjusting a transverse position of the slide board with respect to the base in a transverse direction; and third adjusting means arranged between the side plates and the connection member of the base for adjusting a vertical position of the base that carries the slide board with respect to the casing.

2. The adjustment device as claimed in claim 1, wherein each side plate of the casing defines an elongated hole.

3. The adjustment device as claimed in claim 2, wherein each side plate forms two lugs on opposite side of the elongated hole in the vertical direction.

4. The adjustment device as claimed in claim 3, wherein at least one lug defines an inner-threaded hole.

5. The adjustment device as claimed in claim 1 further comprising a cross bar extending between the side plates.

6. The adjustment device as claimed in claim 5 further comprising a presser mounted to the cross bar.

7. The adjustment device as claimed in claim 5 further comprising a control switch coupled to the cross bar.

8. The adjustment device as claimed in claim 1, wherein the bottom board having opposite edges, each forming a retainer.

9. The adjustment device as claimed in claim 8, wherein the retainer forms an inner-threaded hole.

10. The adjustment device as claimed in claim 1, wherein the base comprises an offset rear flange to which the connection member is fixed.

11. The adjustment device as claimed in claim 10, wherein the flange defines holes to receive fasteners for securing the connection member thereto.

12. The adjustment device as claimed in claim 1 further comprising a helical spring encompassing one of the ends of the connection member for resiliently coupling the connection member to the retention plate of the casing.

13. The adjustment device as claimed in claim 1 further comprising two retention lugs formed on the slide board.

14. The adjustment device as claimed in claim 1, wherein the slide board defines at least one observing window, which exposes a front edge of the bottom board.

15. The adjustment device as claimed in claim 14, wherein indexing marks are formed along an edge of the observing window to indication relative position of the slide board with respect to the bottom board of the base.

16. The adjustment device as claimed in claim 1, wherein the first adjusting means comprises:

at least one adjusting bolt extending in the longitudinal direction through a hole defined in a retention lug formed on the slide board;

a helical spring encompassing the adjusting bolt; and a connection arm defining a longitudinally extending inner threaded hole engaging the adjusting bolt, the connection arm being coupled to the bottom board of the base whereby by rotating the adjusting bolt, the slide board is moved with respect to the bottom board of the base in the longitudinal direction to accomplish the adjustment of the longitudinal position of the printer head.

17. The adjustment device as claimed in claim 16, wherein the connection arm defines a transversely extending hole.

18. The adjustment device as claimed in claim 1, wherein the second adjusting means comprises:

a threaded rod rotatably coupled to and carrying the first adjusting means that in turn carries the slide board, and having an end threadingly engaging a transversely extending inner-threaded hole defined in a retainer formed on the bottom board of the base; and a knob coupled to the threaded rod for manual rotation of the threaded rod to move the threaded rod and the first adjusting means that carries the slide board in the transverse direction thereby accomplishing adjustment of the transverse position.

19. The adjustment device as claimed in claim 18 further comprising a tube fit over the threaded rod and C-clips arranged on opposite ends of the tube to fix the first adjusting means to the threaded rod on the ends of the tube.

20. The adjustment device as claimed in claim 1, wherein the third adjusting means comprises:

a movable base extending beyond the side plate and coupled to the connection member; and a threaded rod vertically extending through and threadingly engaging the movable base, the threaded rod further threadingly engaging a lug formed on the side plate for moving the movable base with respect to the side plate of the casing in the vertical direction thereby accomplishing adjustment of the vertical position.

21. The adjustment device as claimed in claim 20, wherein the movable base defines a vertically extending inner-threaded hole for engaging the threaded rod.

22. The adjustment device as claimed in claim 20, wherein an end of the threaded rod forms a stop.

23. The adjustment device as claimed in claim 20, wherein an end of the threaded rod forms an operating head.

* * * * *